US005934501A

United States Patent [19]

Wright et al.

[11] Patent Number: 5,934,501

[45] Date of Patent: Aug. 10, 1999

[54] BEVERAGE CONTAINER FOR USE WITH DRINKING CUP

[76] Inventors: Graham Wright; Sylvia Jodi Wright, both of 10550 Fascinaton La., Royal Palm Beach, Fla. 33411

[21] Appl. No.: 08/987,293

[22] Filed: Dec. 9, 1997

[51] Int. Cl.[6] ..... A47G 19/00

[52] U.S. Cl. ..... 220/528; 220/23.83

[58] Field of Search ..... 220/528, 575, 220/23.86, 23.87, 23.88, 23.89, 555, 23.83; 229/400

[56] References Cited

U.S. PATENT DOCUMENTS

| | | | |
|---|---|---|---|
| 909,715 | 1/1909 | Troegeler . | |
| 1,164,050 | 12/1915 | Zodac . | |
| 1,488,397 | 3/1924 | Judge et al. | 220/23.88 X |
| 1,848,331 | 3/1932 | Esslinger | 220/23.88 X |
| 2,428,056 | 9/1947 | Wachsman . | |
| 3,323,706 | 6/1967 | Gereke . | |
| 3,442,435 | 5/1969 | Ludder et al. | 220/528 |
| 4,919,295 | 4/1990 | Hitzler . | |
| 4,955,503 | 9/1990 | Propes | 220/555 X |
| 5,180,079 | 1/1993 | Jeng . | |
| 5,198,127 | 3/1993 | Tilley et al. . | |
| 5,405,030 | 4/1995 | Frazier . | |
| 5,492,244 | 2/1996 | Kim . | |

*Primary Examiner*—Steven Pollard
*Attorney, Agent, or Firm*—Malin, Haley, DiMaggio & Crosby, PA

[57] ABSTRACT

A beverage container for use with a drinking cup for dividing the cup into at least two individual beverage containing cells, each of which forms a discrete beverage container separate from the other. The beverage container comprises a semi-cylindrical, vertically tapered device, sized and shaped for mating insertion into a conventional tapered drinking cup. The beverage container includes a side wall having a top rim forming an opening, and a bottom. The side wall includes a curved, vertically tapered first side wall portion and a generally planar, vertically tapered second side wall portion. An elongated flexible tab is connected on one end thereof along a curved portion of the beverage container rim and folds over the rim of the cup upon insertion. The tab includes indicia for identifying the particular type, flavor, or brand of beverage contained within the beverage container portion of the drinking cup. The present invention thus allows a consumer to enjoy more than one flavor of beverage from a single cup, or, alternatively, allows a consumer to share a drink with a companion in a sanitary manner while allowing the consumer and companion to each consume his or her beverage of choice.

9 Claims, 4 Drawing Sheets

BEVERAGE CONTAINER FOR USE WITH DRINKING CUP

BACKGROUND OF THE INVENTION

1. Field of the Invention

The present invention relates to beverage containers, and, more particularly to an insertable beverage container for use with a conventional drinking drink cup for dividing the cup into a plurality of individual beverage containing cells thereby enabling different flavored beverages to be separately contained within, and consumed from, a single cup.

2. Description of Related Art

Beverage containers, such as cups, are commonly used in the consumption of beverages. Cups, such as the soda cup for example, are a well known drinking containers in common use throughout the world and are often used in drinking refreshing beverages such as soft drinks and the like. Disposable soda cups are typically formed from wax-coated paper, plastic, or expanded rigid polystyrene plastic known by the trademark Styrofoam. Although cups are available in a variety of sizes (i.e. large, medium and small) and may contain up to forty (40) fluid ounces of beverage or more, most cups are formed in a generally cylindrical, vertically tapered shape.

Consumers frequently purchase individual servings of soft drinks at any of a wide variety of retail locations such as restaurants, convenience stores, fast food stores, and movie theaters. Typically, the cup is filled with ice and a particular flavored beverage, such as Coca-Cola®. In many instances a plastic top or lid is secured about the rim of the cup and a drinking straw is inserted through a pre-formed opening in the lid. The cup, lid, and drinking straw provide consumers with low-cost drinking containers that are commonly disposed of after a single use.

There are, however, a number of inherent disadvantages associated with the use of conventional drinking cups. For example, plastic lids used with a conventional drinking cups can become dislodged if the cup is dropped thereby allowing the contents to spill out. Accordingly, soda cups placed in the hands of children, who consume a substantial amount of soft drinks, present a constant potential for spillage. In addition, since there are a wide variety of beverage flavors currently available, and, since soda cups have but a single beverage containing compartment, and thus are only able to hold a single beverage flavor at any one time, each person typically requires his or her own cup to filled with a particular beverage to satisfy his or her individual taste. Even if two people are willing to share a soft drink, the potential for passing germs, the common cold, and the like, make sharing, even among family members, a generally undesirable option. Furthermore, the large number of disposable soda cups used daily creates an equally large amount of waste that must be disposed of in landfills.

The background art reveals references generally directed to divided beverage containers. For example, U.S. Pat. Nos. 4,919,295, and 5,492,244, issued to Hitzler and Kim respectively, disclose cylindrical aluminum cans having individual fluid containing chambers therein. U.S. Pat. No. 5,405,030, issued to Frazier, discloses a dual-compartment drinking cup. The references of the background art do not reveal, however, an apparatus for use with a conventional soda cup for dividing the cup into a plurality of individual beverage containing compartments.

Accordingly, there exists a need for an apparatus for providing a soda cup with a plurality of individual beverage containing cells to accommodate different flavored beverages and to allow sharing of the beverages by individuals in a sanitary manner.

BRIEF SUMMARY OF THE INVENTION

An beverage container and insert for use with a drinking cup for dividing the cup into at least two discrete fillable volumes, each of which forms a discrete beverage containing cell separate from the other. In the preferred embodiment, a beverage container according to the present invention comprises a semi-cylindrical, vertically tapered vessel, sized and shaped for mating insertion into a conventional tapered drinking cup, which, upon insertion, occupies a portion of the cup volume thereby dividing the cup into two individually fillable volumes. The insertable beverage container comprises a side wall, having a top rim forming an opening, and a bottom. The side wall includes a curved, vertically tapered first side wall portion and a generally planar, vertically tapered second side wall portion.

An elongated flexible tab is connected on one end thereof along a curved portion of the container rim and folds over the rim of the cup upon insertion. The tab is folded over the rim of the cup, and remains substantially exposed when the insertable beverage container is placed in the cup and a lid affixed. The tab preferably includes indicia for conveying information to the consumer such as the identity of the beverage contained within the container. The invention further contemplates a lid having a plurality of straw insertion locations, each location for accommodating a drinking straw disposed therethrough in fluid communication with a beverage in either the insertable container insert or the cup.

Accordingly, the invention provides a divided drinking cup having a plurality of individual beverage containing cells thereby enabling different flavored beverages to be separately contained within, and consumed from, a single cup. A beverage container according to the present invention is easily mass produced for use with suitably sized drinking cups available at retail locations. Accordingly, the present invention provides consumers with the option of purchasing a single cup filled with different flavored beverages. The present invention thus allows a consumer to enjoy more than one flavor of beverage from a single cup, or, alternatively, allows a consumer to share a drink with a companion in a sanitary manner while allowing the consumer and companion to each consume his or her beverage of choice.

In accordance with these and other objects which will become apparent hereinafter, the instant invention will now be described with particular reference to the accompanying drawings.

DETAILED DESCRIPTION OF THE INVENTION

Figure 2:
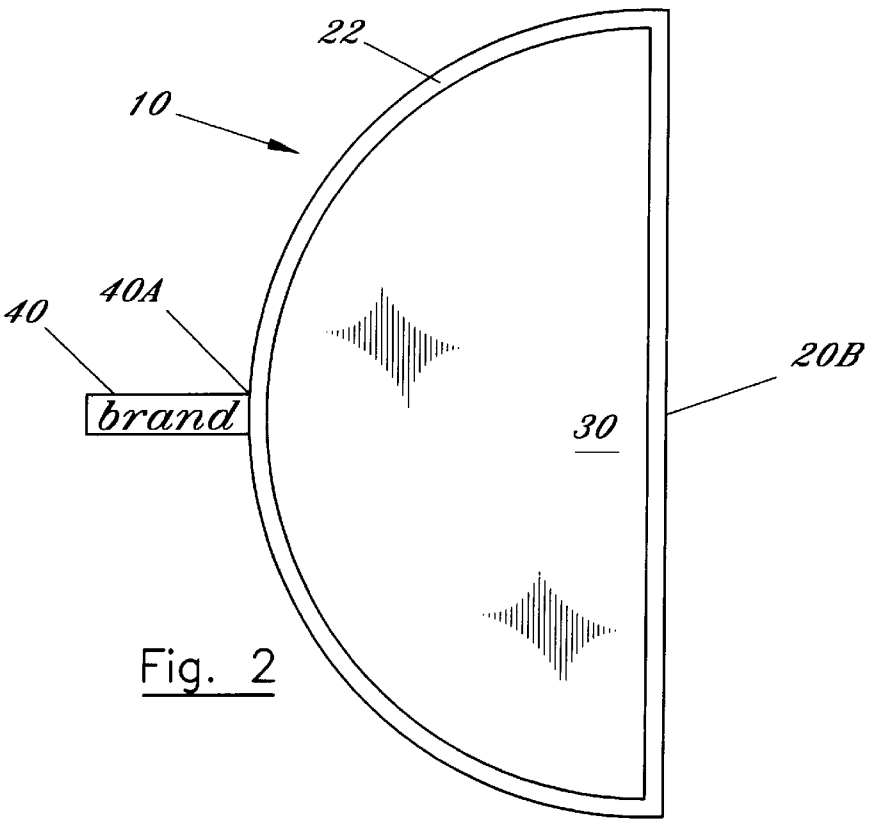
FIG. 2 is a top plan view of the beverage container shown in FIG. 1.
Figure 1:
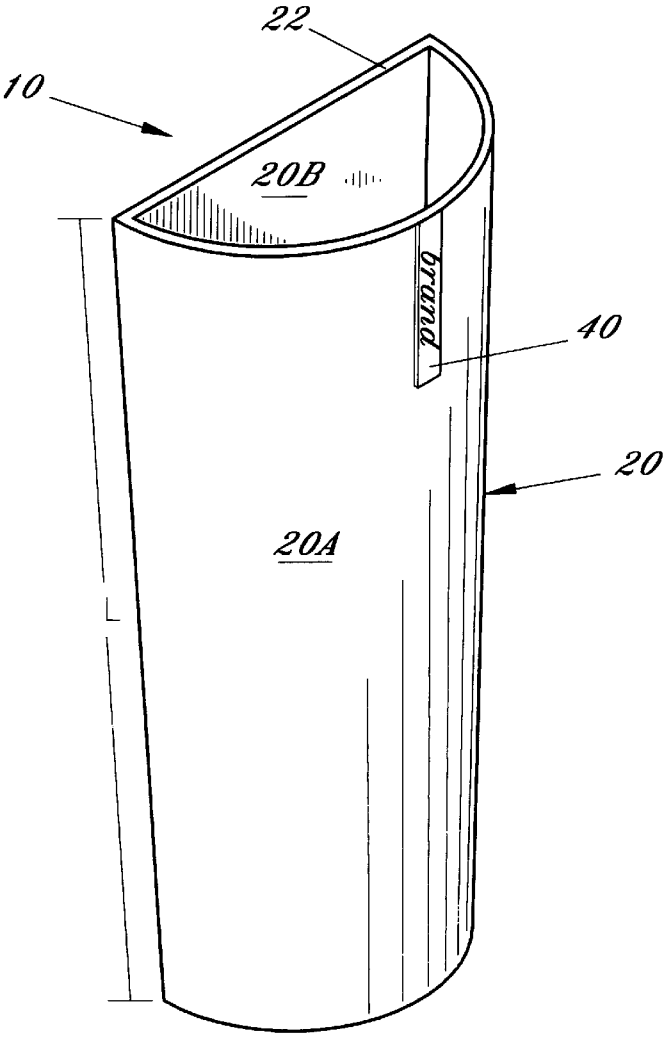
FIG. 1 is a perspective view of a beverage container according to the present invention.

FIGS. 1 and 2 depict a preferred embodiment of a beverage container according to the present invention, generally referenced as 10. Beverage container 10 comprises a semi-cylindrical, vertically tapered vessel, sized and shaped for mating insertion into a conventional tapered drinking cup. The beverage container comprises a side wall, generally referenced as 20, having a top rim 22 forming an opening, and a bottom 30 connected to side wall 20 thereby forming a liquid containing volume within the container. In the preferred embodiment, side wall 20 includes a curved, vertically tapered first side wall portion 20A, and a generally planar, vertically tapered second side wall portion 20B. Beverage container 10 may be fabricated from wax-coated paper, plastic, expanded rigid polystyrene plastic, or any suitable material capable of forming a watertight volume. Beverage container 10 is preferably sized for full length insertion within a drinking cup, and has a length "L" that is substantially equal to the length of a drinking cup used therewith.

Beverage container 10 further includes an elongated flexible tab 40, having a first end thereof 40A connected to container 10, preferably along a curved portion of rim 22, and a second end thereof freely extending therefrom. Tab 40 preferably includes indicia for conveying information to the consumer, such as the identity of the beverage (e.g. Coca-Cola®) contained within cell formed by the beverage container. In a preferred embodiment, tab 40 will identify the contents of the beverage container thereby allowing the purchaser to identify the particular beverage contained therein, and distinguish the beverage contained within the beverage container from the other beverage contained within the cup volume not occupied by the insertable beverage container 10.

Figure 5:
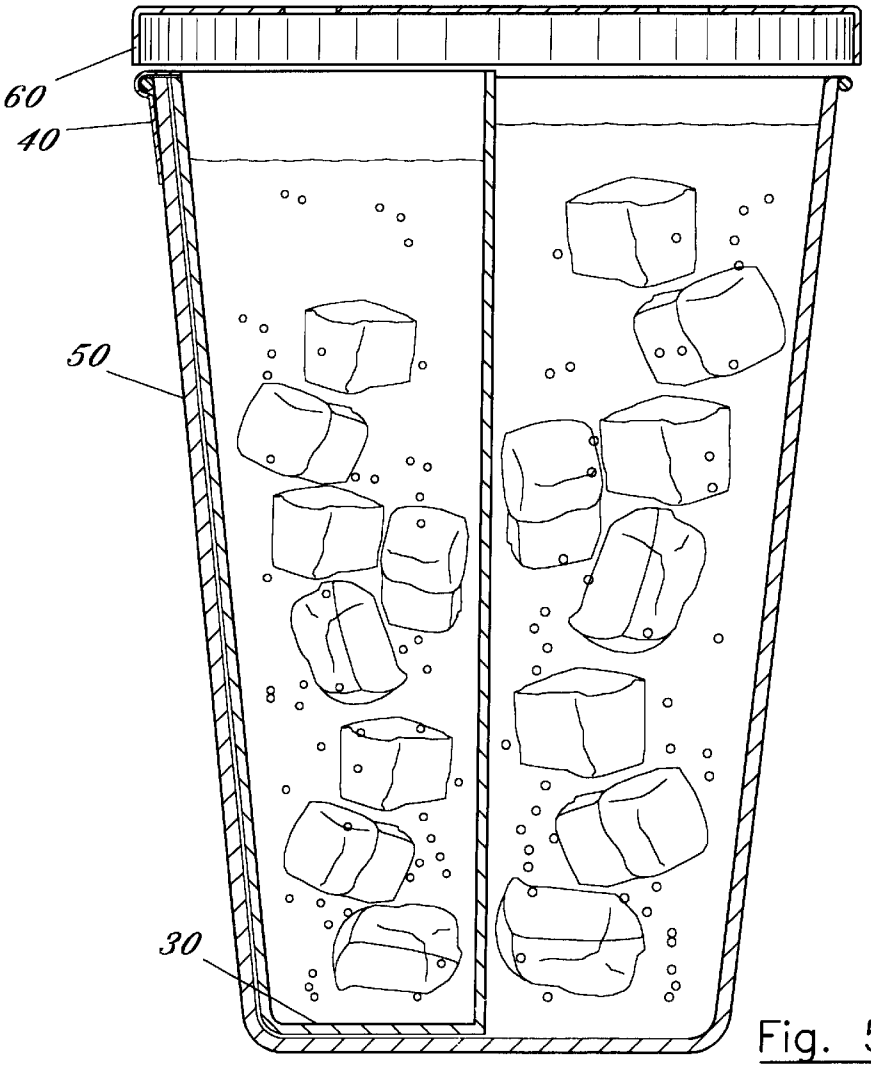
FIG. 5 is a side sectional view of a beverage container, according to the present invention, disposed within a cup.
Figure 3:
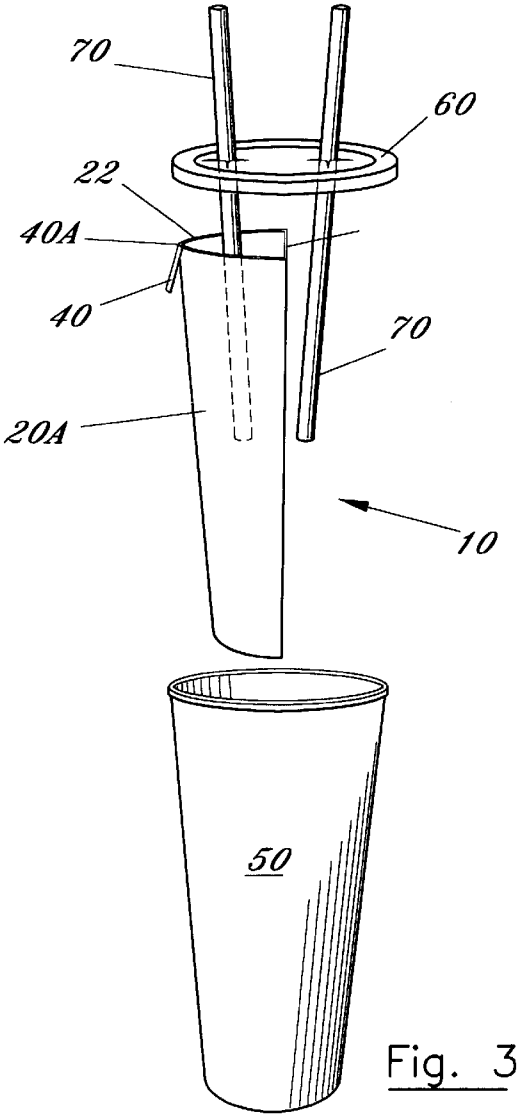
FIG. 3 is a an exploded perspective view of a cup used in combination with a beverage container according to the present invention.
Figure 4:
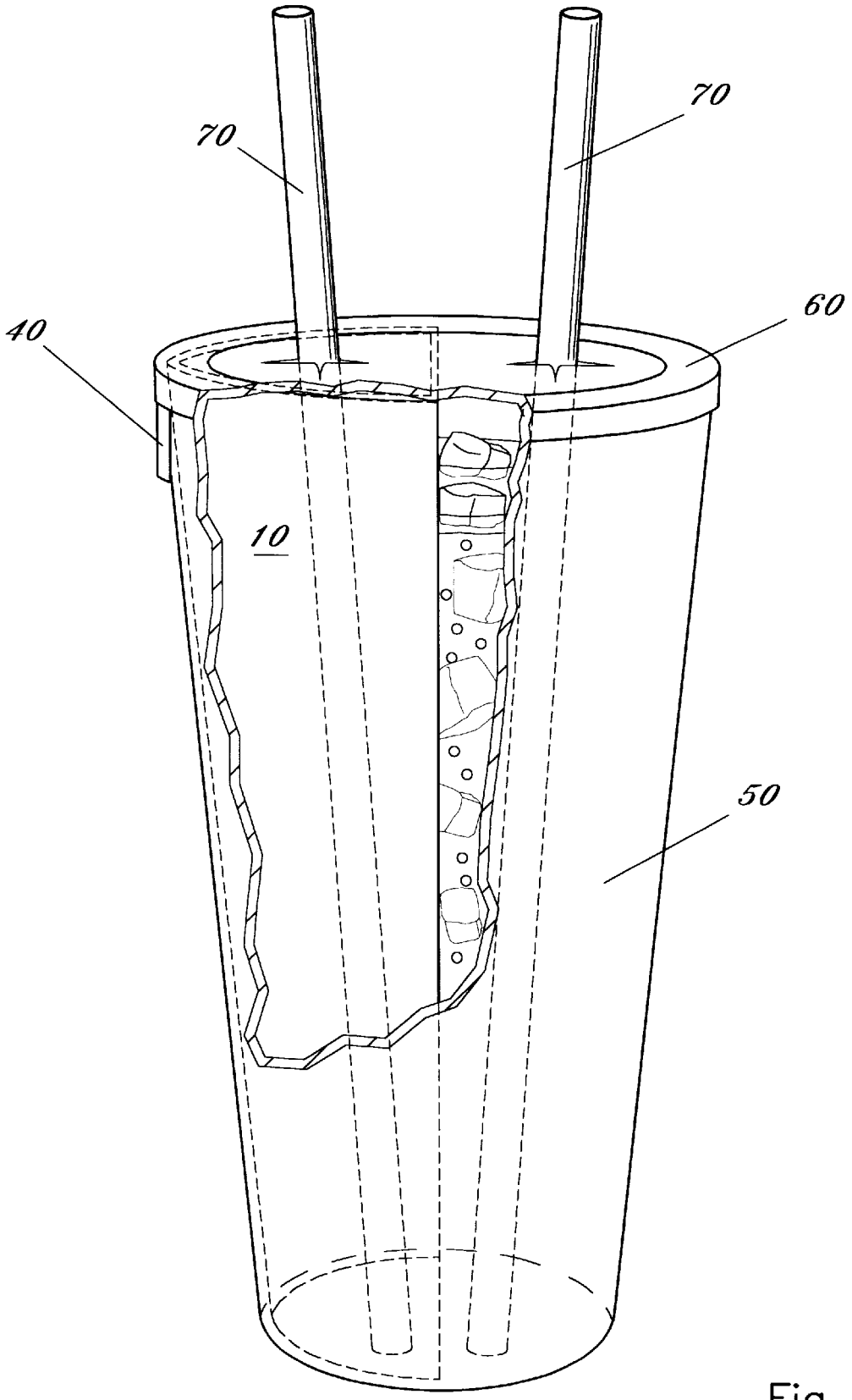
FIG. 4 is a perspective view, partially cut-away, of a beverage container according to the present invention disposed within a cup.

As best depicted in FIGS. 3–5, beverage container 10 is designed for mating reception within a cup 50. The curved side wall 20A, of beverage container 10, has a radius of curvature that reduces from top to bottom such that side wall 20A conforms to the tapered inner radius of curvature of the cup wall. Upon placement of liquid container 10 within cup 50, tab 40 is folded over the cup rim and remains substantially exposed. Tab 40 further provides a structural element that functions to anchor the liquid container within the cup by allowing the server's hand to pin the tab against the exterior surface of the cup to enable the server to manipulate the cup while filling the cup and liquid container with ice and beverage. Accordingly, tab 40 serves to anchor the liquid container within the cup so that the server does not have to place his or her fingers in contact with the beverage containing surfaces of either the liquid container or the cup.

Figure 6:
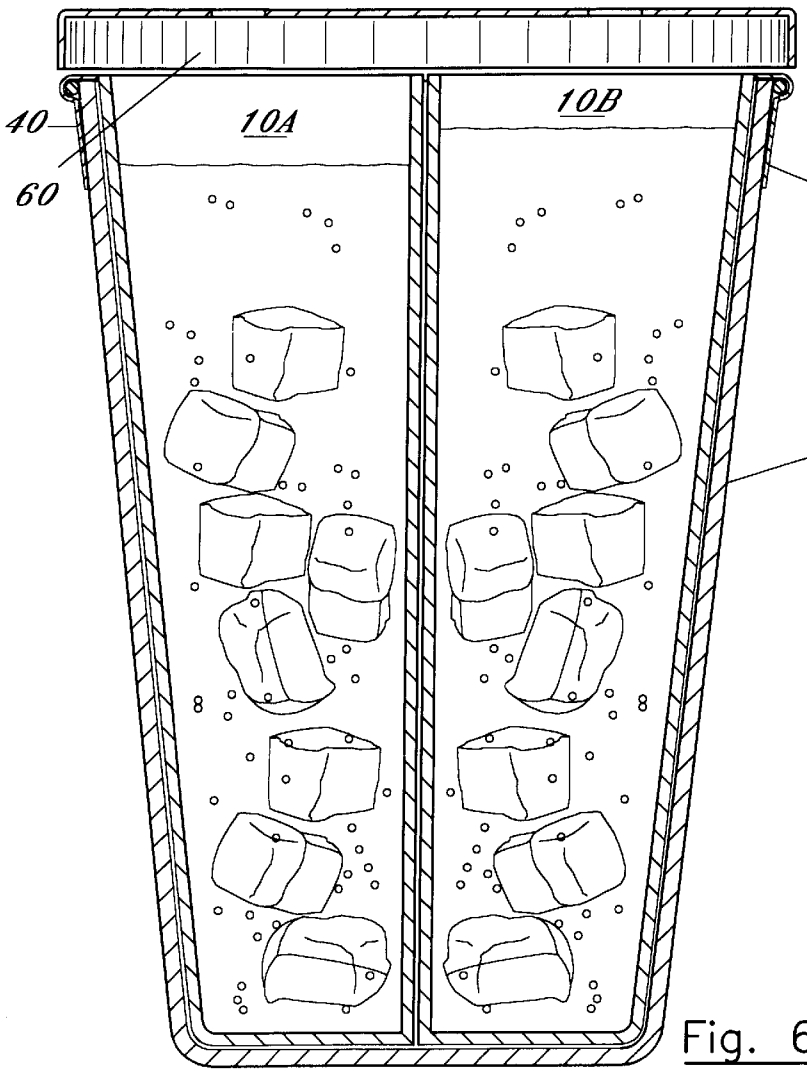
FIG. 6 is a side sectional view showing two full length beverage containers disposed within a cup.

The invention further contemplates a lid 60 having a plurality of straw insertion locations, each location for accommodating a drinking straw 70 disposed therethrough as best depicted in FIG. 3. FIG. 4 depicts a cut away perspective view of an insert 10 disposed within a drinking cup 50 and dividing the cup into two separate beverage containing cells. Specifically, a first beverage containing cell consists of the volume defined within liquid container 10, and a second beverage containing cell consists of the remaining volume of the cup (i.e. that volume within the cup that is not occupied by liquid container 10). FIG. 5 depicts a cross-sectional view of a cup 50 having a liquid container according to the present invention disposed therein, with beverages contained in each of the first and second volumes. FIG. 6 depicts a cup 50 having two liquid containers 10A and 10B disposed therein.

Figure 7:
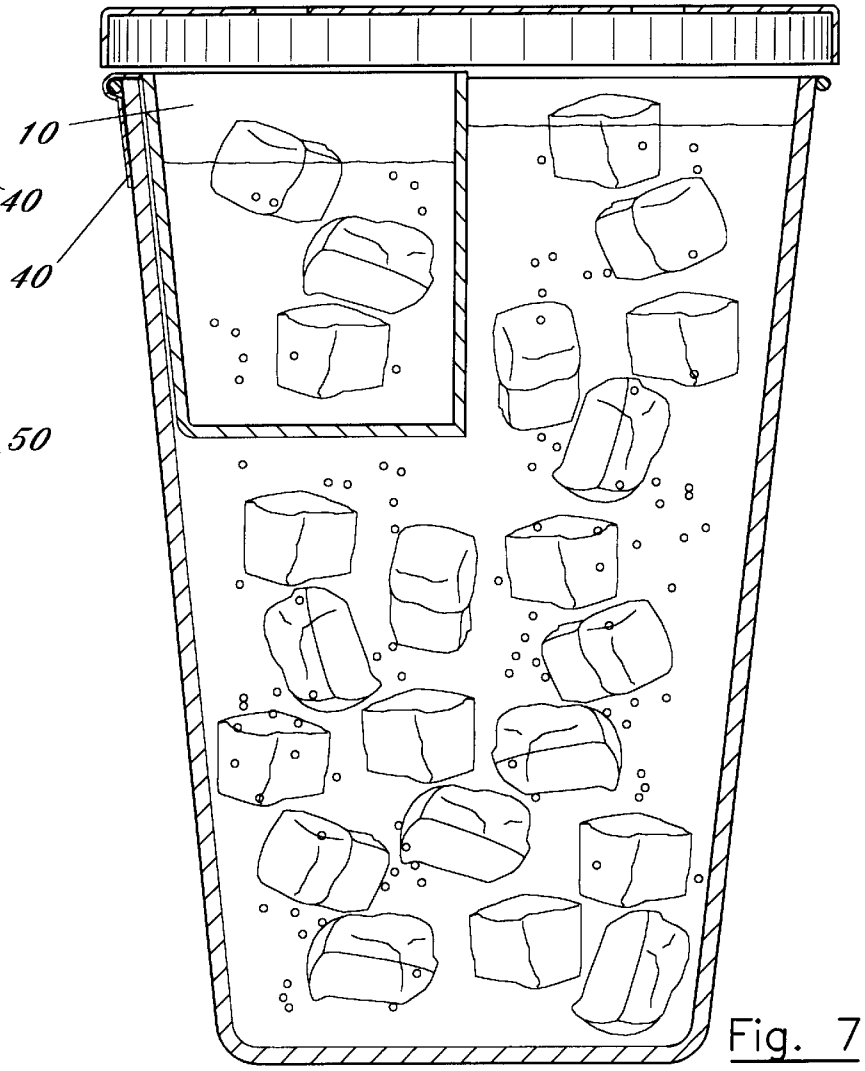
FIG. 7 is a side sectional view showing a partial length beverage container disposed within a cup.

FIG. 7 depicts an alternate embodiment insert formed having a length which is substantially less than the overall length of the cup such that two separate and unequal beverage containing cells are formed. The embodiment depicted in FIG. 7 is contemplated for providing a divided drinking cup wherein it is desirable to divide the cup into unequal beverage containing volumes in situations, for example, where an adult and child purchase beverages for consumption together while attending a movie theater.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A liquid container for insertion within a truncated conical drinking cup having an inside waterproof truncated conical wall surface for dividing the drinking cup into two liquid fillable volumes, said liquid container comprising:

a watertight body having peripheral side wall and a bottom connected to said side wall, said side wall having an upper portion terminating in a rim defining an open top, said side wall and said bottom defining a watertight first volume;

said side wall defining an arcuate truncated, semi-conical portion and a substantially planar portion;

a tab having an end thereof connected to said rim;

said watertight body sized for insertion into a drinking cup, the outside shape and diameter of said arcuate truncated semi-conical side wall being matched to snugly fit against the inside wall surface of said drinking cup whereby beverages may be separately contained within said first volume and within a second volume defined within the drinking cup and external to said body.

2. A liquid container for insertion within a drinking cup according to claim 1, wherein said tab is elongated and flexible.

3. A liquid container for insertion within a drinking cup according to claim 2, wherein said tab includes indicia thereon for identifying the particular beverage contained within said first volume.

4. A liquid container for insertion within a drinking cup according to claim 1, wherein said body is formed from one of the following materials: paper, plastic, or expanded rigid polystyrene.

5. A beverage container for insertion within a drinking cup for dividing the drinking cup into two liquid fillable volumes, said drinking cup having an arcuate vertically-tapered conical waterproof side wall including an inside wall surface of a predetermined conical shape and diametrical size upwardly terminating in a lip, said liquid container comprising:

a watertight beverage container body having a truncated semi-conical peripheral side wall and a flat, bottom connected to said side wall, said side wall having an upper portion terminating in a rim defining an open top, said side wall and said bottom defining a watertight first volume of a predetermined semi-conical outside shape and diametrical size;

said side wall defining an arcuate portion and a substantially planar portion, said arcuate portion being semi-conical for mating engagement with the conical inside side wall of said drinking cup;

an elongated tab having an end thereof connected to said rim, said tab folding over the lip of said cup when said watertight body is disposed therein;

said watertight body having a length sized for insertion and snug fit into said drinking cup, whereby beverages may be separately contained within said first volume and within a second volume defined within the drinking cup and external to said body.

6. A beverage container for insertion within a drinking cup according to claim 5, wherein the length of said watertight body is substantially equal to the length of said drinking cup.

7. A beverage container for insertion within a drinking cup according to claim 5, wherein the length of said watertight body is less than the length of said drinking cup.

8. A beverage container for insertion within a drinking cup according to claim 5, wherein said tab includes indicia thereon for identifying the particular beverage contained within said first volume.

9. A beverage container having two individual beverage containing cells, one cell of which is removable and insertable, said beverage container comprising:

a drinking cup having an arcuate, vertically-tapered, truncated conical peripheral waterproof wall including an upper lip, and a flat bottom;

a watertight body insertable within said drinking cup, said watertight body having an side wall and a flat bottom defining a first volume, said side wall having an upper portion terminating in a rim and defining an open top, said side wall having an arcuate truncated semi-conical portion and a substantially planar portion, said arcuate portion being semi-conically sized and shaped for mating with the conical peripheral wall of said drinking cup, said watertight body defining a first volume;

an elongated tab having an end thereof connected to said rim and externally folding over the lip of said cup, said tab having indicia thereon for identifying a beverage contained within said watertight body;

said watertight body having a length sized for insertion and snug fit into said drinking cup, whereby beverages may be separately contained within said first volume and within a second volume defined within the drinking cup and external to said body;

a lid connected to the lip of said cup, said lid having first and second straw insertion locations defined thereon; and a first drinking straw inserted within said first location and communicating with a beverage contained within said first volume; and a second drinking straw inserted within said second location and communicating with a beverage contained within said second volume.

* * * * *